US008077053B2

(12) United States Patent
Thompson et al.

(10) Patent No.: US 8,077,053 B2
(45) Date of Patent: Dec. 13, 2011

(54) METHOD AND APPARATUS FOR SENSING A BOREHOLE CHARACTERISTIC

(75) Inventors: M. Clark Thompson, Los Alamos, NM (US); Koby Carlson, Hobbs, NM (US); Don M. Coates, Santa Fe, NM (US); Manuel E. Gonzalez, Kingwood, TX (US); Brian C. Llewellyn, Kingwood, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 1602 days.

(21) Appl. No.: 11/394,186

(22) Filed: Mar. 31, 2006

(65) Prior Publication Data

US 2007/0235184 A1 Oct. 11, 2007

(51) Int. Cl.
*E21B 43/00* (2006.01)

(52) U.S. Cl. ..... 340/855.7; 340/853.1; 340/853.3; 166/252.5; 367/32; 367/81

(58) Field of Classification Search ..... 166/252.5; 340/853.3, 853.1, 853.7; 367/32, 81
See application file for complete search history.

(56) References Cited

U.S. PATENT DOCUMENTS

| | | | | | |
|---|---|---|---|---|---|
| 4,834,210 | A * | 5/1989 | Kennedy | 181/106 |
| 4,962,489 | A * | 10/1990 | Medlin et al. | 367/32 |
| 4,993,001 | A * | 2/1991 | Winbow et al. | 367/144 |
| 5,268,537 | A * | 12/1993 | Winbow et al. | 181/106 |
| 5,406,530 | A * | 4/1995 | Yamamoto | 367/57 |
| 5,886,303 | A * | 3/1999 | Rodney | 181/102 |
| 6,094,401 | A * | 7/2000 | Masak et al. | 367/84 |
| 6,172,614 | B1 * | 1/2001 | Robison et al. | 340/853.3 |
| 6,388,577 | B1 * | 5/2002 | Carstensen | 340/854.3 |
| 6,456,566 | B1 * | 9/2002 | Aronstam | 367/86 |
| 6,626,253 | B2 * | 9/2003 | Hahn et al. | 175/48 |
| 6,766,141 | B1 * | 7/2004 | Briles et al. | 455/40 |
| 6,795,373 | B1 * | 9/2004 | Aronstam | 367/85 |

* cited by examiner

*Primary Examiner* — Timothy Edwards, Jr.
*Assistant Examiner* — Amine Benlagsir
(74) *Attorney, Agent, or Firm* — Merchant & Gould

(57) ABSTRACT

An apparatus and method are disclosed for sensing a characteristic of a borehole. An exemplary apparatus includes a conductive pipe; an inlet, connected to the conductive pipe, for applying pulse to the conductive pipe; a resonant network device connected with the conductive pipe; and a transducer which is in operative communication with the resonant network device to measure a borehole characteristic, the transducer being configured to sense a modulated vibration frequency induced in the resonant network device when a pulse is applied to the inlet.

25 Claims, 8 Drawing Sheets

METHOD AND APPARATUS FOR SENSING A BOREHOLE CHARACTERISTIC

BACKGROUND

An apparatus and method are disclosed for sensing a characteristic of a borehole.

U.S. Pat. No. 6,766,141 (Briles et al) discloses a system for remote down-hole well telemetry. The telemetry communication is used for oil well monitoring and recording instruments located in a vicinity of a bottom of a gas or oil recovery pipe. Modulated reflectance is described for monitoring down-hole conditions.

As described in U.S. Pat. No. 6,766,141, a radio frequency (RF) generator/receiver base station communicates electrically with the pipe. The RF frequency is described as an electromagnetic radiation between 3 Hz and 30 GHz. A down-hole electronics module having a reflecting antenna receives a radiated carrier signal from the RF generator/receiver. An antenna on the electronics module can have a parabolic or other focusing shape. The radiated carrier signal is then reflected in a modulated manner, the modulation being responsive to measurements performed by the electronics module. The reflected, modulated signal is transmitted by the pipe to the surface of the well where it can be detected by the RF generator/receiver.

SUMMARY

Exemplary embodiments of the present invention are directed to an apparatus and method for sensing a characteristic of a borehole. An exemplary apparatus includes a conductive pipe; an inlet coupled (e.g., connected) to the conductive pipe, for applying a pulse to the conductive pipe; a resonant network device (such as a resonant cavity) connected with the conductive pipe; and a transducer which is in operative communication with the resonant network device to measure a borehole characteristic, the transducer being configured to affect a modulation of a resonator vibration frequency induced in the resonant network device when a pulse is applied to the inlet.

In accordance with alternate embodiments, an apparatus for sensing a characteristic of a borehole comprises means for conducting a pulse through a borehole; means, responsive to the pulse, for resonating at a frequency which is modulated as a function of a characteristic of the borehole; and means for processing the modulated frequency as a measure of the characteristic.

A method for sensing a characteristic of a borehole is also disclosed. An exemplary method includes transmitting a pulse along a conductive pipe located within the borehole; and sensing a modulated vibration frequency induced by the pulse within a resonant network device, located within a hollow borehole casing, as a measure of the borehole characteristic.

BRIEF DESCRIPTION OF THE DRAWINGS

Other advantages and features described herein will be more readily apparent to those skilled in the art when reading the following detailed description in connection with the accompanying drawings, wherein.

DETAILED DESCRIPTION

Figure 1B:
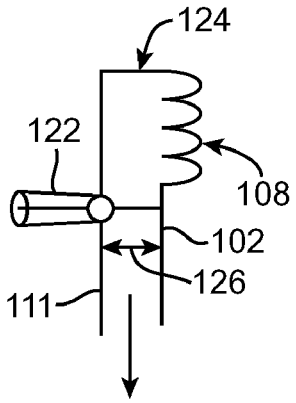
FIGS. 1A-1D show an exemplary embodiment of an apparatus for sensing a characteristic of a borehole.

FIG. 1 shows an exemplary apparatus 100 for sensing a characteristic of a borehole. The borehole can be any cavity, configured with any orientation, having a characteristic such as a material composition, temperature, pressure, flow rate, or other characteristic, which can vary along a length of the borehole.

The apparatus 100 includes a means, such as a conductive pipe 102, for conducting a pulse through the borehole. An inlet 104, coupled (e.g., connected) to the conductive pipe 102, is provided for applying a pulse to the conductive pipe. In an exemplary embodiment, the pulse can be an electrical transient pulse or any desired electrical pulse of any desired frequency selected, for example, as a function of characteristics to be measured within the borehole and as a function of the length and size of the borehole.

The inlet includes a probe 106 coupled with the conductive pipe 102. The probe can be formed, for example, as a coaxial connector having a first (e.g., interior) conductor coupled electrically to the conductive pipe 102, and having a second (e.g., exterior) conductive casing coupled to a hollow borehole casing 111. An insulator is used to separate the interior conductor from the exterior conductive casing.

The inlet can include an inductive isolator, such as a ferrite inductance 108 or other inductor or component, for electrically isolating the inlet from a first potential (e.g., a potential, such as a common ground, of the return current path of the borehole casing 111) at a location in a vicinity of the inlet 104. The apparatus 100 can include a means, such as a pulse generator 105, coupled to the inlet for generating the pulse to be applied to the conductive pipe.

The hollow borehole casing 111 can be placed into the borehole whose characteristics are to be monitored. The hollow borehole casing 111 can, for example, be configured of steel or other suitable material.

The conductive pipe 102 can be located within, and electrically isolated from, the hollow borehole casing using spacers 116. The spacers can, for example, be configured as insulated centralizers which maintain a separation distance of the conductive pipe 102 from the inner walls of the hollow borehole casing 111. These insulating spacers can be configured as disks formed from any suitable material including, but not limited to nylon.

The apparatus 100 includes a means, such as a resonant network device 110 responsive to the pulse, for resonating at a frequency which is modulated as a function of a characteristic of the borehole. The resonant network device 110 can be, for example, any electro-acoustic or other device including, but not limited to any magnetically coupled electrically resonant mechanical structure for performing an electrical resonance, such as the resonant cavity of FIG. 2A, the tank circuit of FIG. 2B, or any other suitable device. The resonant network device can be connected with or mechanically coupled to the conductive pipe. A torroidal core of the resonant network device can be magnetically coupled to the conductive pipe. The torroidal core is a magnetic core formed as a medium by which a magnetic field can be contained and/or enhanced. For example, a single turn coil with a one inch cross-section wrapped around a ferrite core, or any other suitable device of any suitable shape, size and configuration can be used.

Those skilled in the art will appreciate that a magnetic core is a material significantly affected by a magnetic field in its region, due to the orientable dipoles within its molecular structure. Such a material can confine and/or intensify an applied magnetic field due to its low magnetic reluctance. The wellhead Ferrite isolator can provide a compact inductive impedance in a range of, for example, 90-110 ohms reactive between an inlet feed point on the pipe and a wellhead flange short. This impedance, in parallel with an exemplary 47 ohm characteristic impedance of the pipe-casing transmission line can reduce the transmitted and received signals by, for example, about ~3 dbV at the inlet feed point for a typical band center at 50 MHz. The magnetic permeability of the ferrite cores discussed herein can range from ~20 to slightly over 100, or lesser or greater. As such, for a given inductance of an air-core inductor, when the core material is inserted, the natural inductance can be multiplied by about these same factors. Selected core materials can be used for the frequency range of, for example, 10-100 MHz, or lesser or greater.

The resonant network device 110 illustrated in FIG. 1 will be described as the resonant cavity, of FIG. 2A. However the tank core of FIG. 2B can be readily substituted, as can any other suitable resonant network device known to those skilled in the art. Referring to FIG. 1, the resonant cavity is electrically connected to the conductive pipe, and is located within the hollow borehole casing 111. A length "b" of the resonant cavity within the hollow borehole casing is defined by an inductive isolator formed, for example, as a torroidal core 112 at a first end of the resonant cavity, and by a connection 114 at a first potential (e.g., common ground) at a second end of the resonant cavity.

The resonant network device 110 receives energy from the pulse, and "rings" at its natural frequency. A means for sensing can include a transducer provided in operative communication with the resonant network device 110, and coupled (e.g., capacitively or magnetically coupled) with the first (e.g., common ground) potential. The transducer is configured to sense a characteristic associated with the borehole, and to modulate the vibration frequency induced in the resonant network device 110 when a pulse is applied to the inlet 104. The modulated vibration frequency can be processed to provide a measure of the borehole characteristic. That is, the vibration frequency induced by the pulse is modulated by a sensed characteristic of the borehole, and this modulation of the vibration can be processed to provide a measure of the characteristic.

A sensing means can include, or be associated with, means for processing, represented as a processor (e.g., computer 118). The processor means can process an output of the resonant network device as transmitted via the borehole casing 111. The processor 118 can provide a signal representing the characteristic to be measured or monitored.

The processor 118 can be programmed to process the modulated vibration frequency to provide a measure of the sensed characteristic. The measure can, for example, be displayed to a user via a graphical user interface (GUI) 120. The processor 118 can perform any desired processing of the detected signal including, but not limited to, a statistical (e.g., Fourier) analysis of the modulated vibration frequency. Commercial products are readily available and known to those skilled in the art to perform any suitable frequency detection (such as a fast Fourier transform that can be implemented by for example. MATHCAD available from Mathsoft Engineering & Education, Inc. or other suitable product to deconvolve the modulated ring received from the resonant network device. The processor can be used in conjunction with a look-up table having a correlation table of modulation frequency-to sensed characteristics (e.g., temperature, pressure, and so forth) conversions.

In an exemplary embodiment, at least a portion of the hollow borehole casing 111 is at the first potential (e.g., common ground). For example, the hollow borehole casing can be at a common ground potential at both a location in a vicinity of the inlet 104, and at a location in a vicinity of the resonant network device 110. The grounding of the hollow borehole casing in a vicinity of the inlet is optional, and establishes a known impedance for the conductive pipe. The grounding of the hollow borehole casing in a vicinity of the resonant network device (that is, at a lower end of the resonant cavity as depicted in FIG. 1A) allows the resonant length to be defined. That is, the resonant cavity has a length within the hollow borehole casing defined by the distance between torroidal coil 112 and by the ground connection at a second, lower end of the resonant cavity.

The transducer can be configured to include passive electrical components, such as inductors and/or capacitors, such that no down-hole power is needed. During an assembly of the FIG. 1 apparatus 100, the conductive pipe can be assembled in sections, and a spacer can be included at each joint between the various pipe sections to ensure stability. Prior to placing the conductive pipe 102 and resonant network device 110 into a borehole, a transducer used for sensing the modulated vibration frequency can be calibrated using the GUI 120 and processor 118.

Details of the exemplary FIG. 1A apparatus will be described further with respect to FIG. 1B, which shows an exemplary telemetry component of the exemplary FIG. 1 apparatus.

In FIG. 1B, the conductive pipe 102 and hollow borehole casing 111 are electrically isolated from one another via the ferrite inductance 108. Where the resonant network device is a natural resonator, the wavelength of the resonant "ring" frequency can dictate the size (e.g., length) of the device. Those skilled in the art will appreciate that the size constraint can be influenced (e.g., reduced) by "loading" the device with inductance and/or capacitance. For example, the amount of ferrite used in an exemplary embodiment can be selected as a function of desired frequency and size considerations.

An instrumentation signal port 122 is provided for receiving the probe 106. A wellhead configuration, as depicted in FIG. 1B, is short circuited to the hollow borehole casing. The ferrite inductor 108 thus isolates the conductive probe of the inlet, which is coupled with the conductive pipe 102, from the top of the wellhead which, in an exemplary embodiment, is at the common ground potential. In an exemplary embodiment, because the wellhead is grounded via short circuiting of the wellhead flange 124 to common ground, the ferrite inductor isolates the short circuited wellhead flange from the conductive pipe used to convey a pulse from the probe to the resonant cavity.

An exemplary impedance 126 between the conductive pipe and the hollow borehole casing 111, can be on the order of 47 ohms, or lesser or greater. This portion of the conductive pipe serves as a transmission line for communication of the downhole electronics, such as the transducer, with the surface electronics, such as the processor.

Figure 1C:
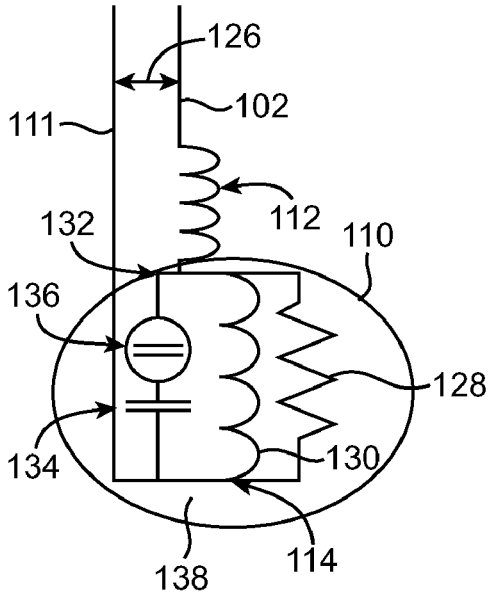
Figure 1A:
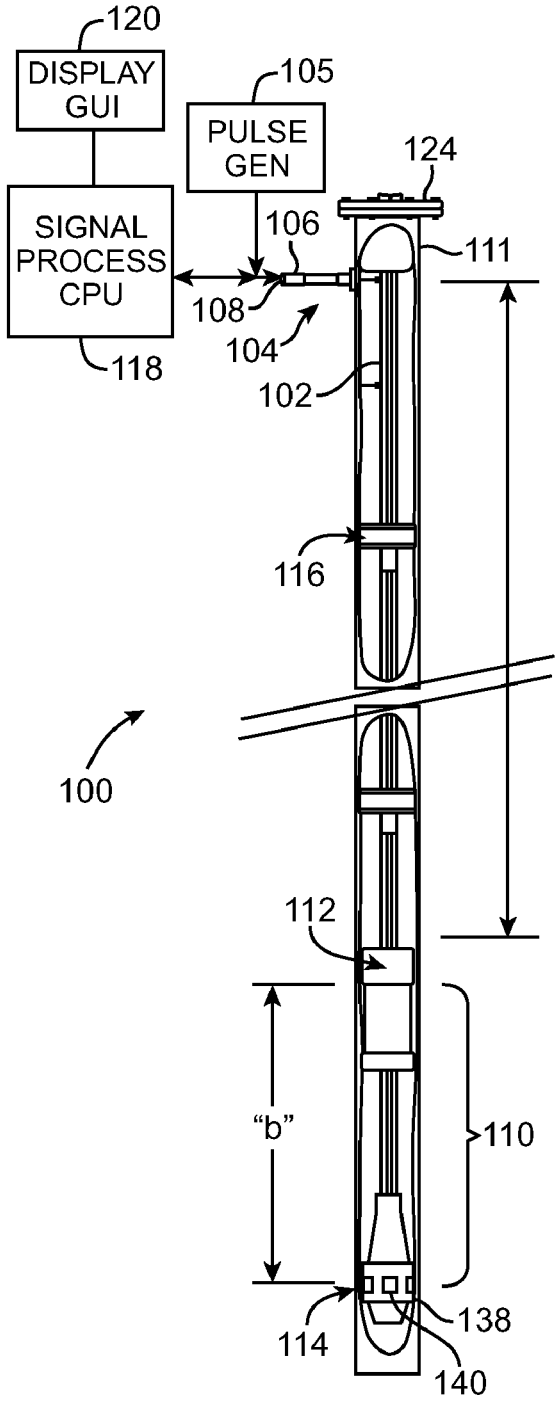

FIG. 1C illustrates an electrical representation of the resonant cavity and transducer included therein. In FIG. 1C, the torroidal core 112 is represented as an inductor section configured of ferrite material for connecting the conductive pipe 102 with the resonant cavity 110. As can be seen in FIG. 1C, for a resonant network device configured as a resonant cavity, an upper portion 132 of the resonant cavity 110 coincides with a lower section of the torroidal core 112 and can be at an impedance which, in an exemplary embodiment, is relatively high as compared to the impedance between conductive pipe 102 and the casing 111. For example, the impedance at the top of the resonant cavity can be on the order of 2000 ohms, or lesser or greater. For magnetic core based, magnetically coupled resonant networks, those measures may have little or no relevance.

This relatively large differential impedance at the top of the resonant cavity relative to the conductive pipe above the resonant cavity provides, at least in part, an ability of the cavity to resonate, or "ring" in response to the pulse and thereby provide a high degree of sensitivity in measuring a characteristic of interest. In addition, the ability of the transducer to provide a relatively high degree of sensitivity is aided by placing a lower end of the resonant cavity at the common ground potential.

The FIG. 1C electrical representation of the resonant network device, for a coaxial cavity formed by the conductive pipe and the borehole casing, includes a representation of the resonant network resistance 128 and the resonant network inductance 130. A lower portion of the cavity defined by the common ground connection 114 is illustrated in FIG. 1C, such that the cavity is defined by the bottom of the torroidal core 112 and the ground connection 114. A capacitance of the sleeve associated with the resonant cavity is represented as a sleeve capacitance 134.

The transducer associated with the resonant cavity for modulating the vibration frequency induced by the pulse, as acted upon by the characteristic to be measured, is represented as a transducer 136.

For a resonant cavity configuration, the bottom of the resonant cavity can include a Packer seal, to prevent the conductive pipe 102 from touching the hollow borehole casing 111. The Packer 138, as illustrated in FIG. 1C and in FIG. 1A, includes exposed conductors 140 which can interface with conductive portions of the resonant cavity and the hollow borehole casing 111 to achieve the common ground connection 114 at a lower end of the resonant cavity.

Figure 1D:
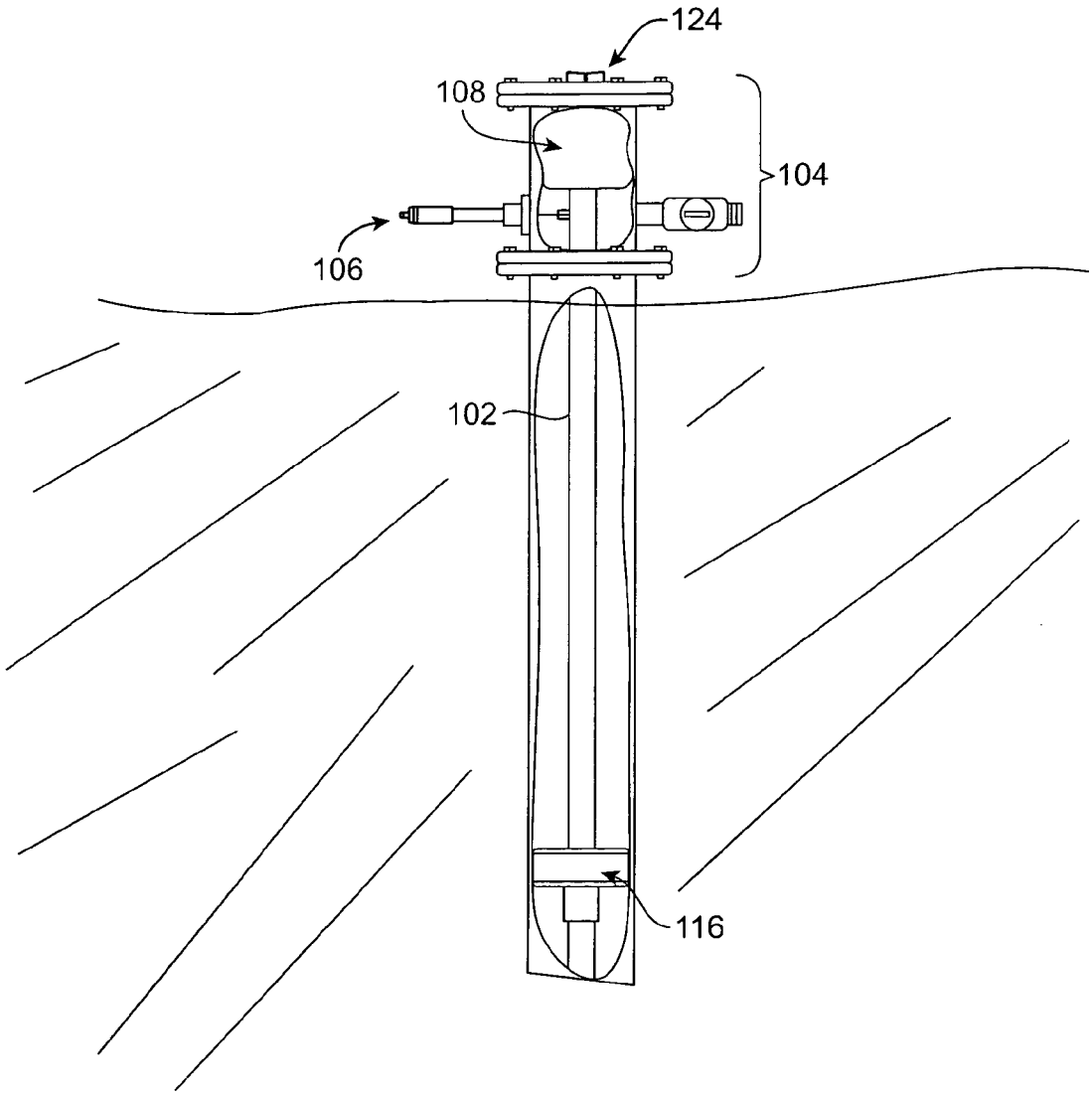

FIG. 1D illustrates another detail of the well telemetry component included at an upper end of the conductive pipe 102. In FIG. 1D, a connection of the probe 106 to the conductive pipe 102 is illustrated as passing through the hollow borehole casing 111, in the inlet 104. FIG. 1D shows that the probe 106 is isolated from the short circuited wellhead flange 124 via the ferrite inductor 108.

Figure 2A:
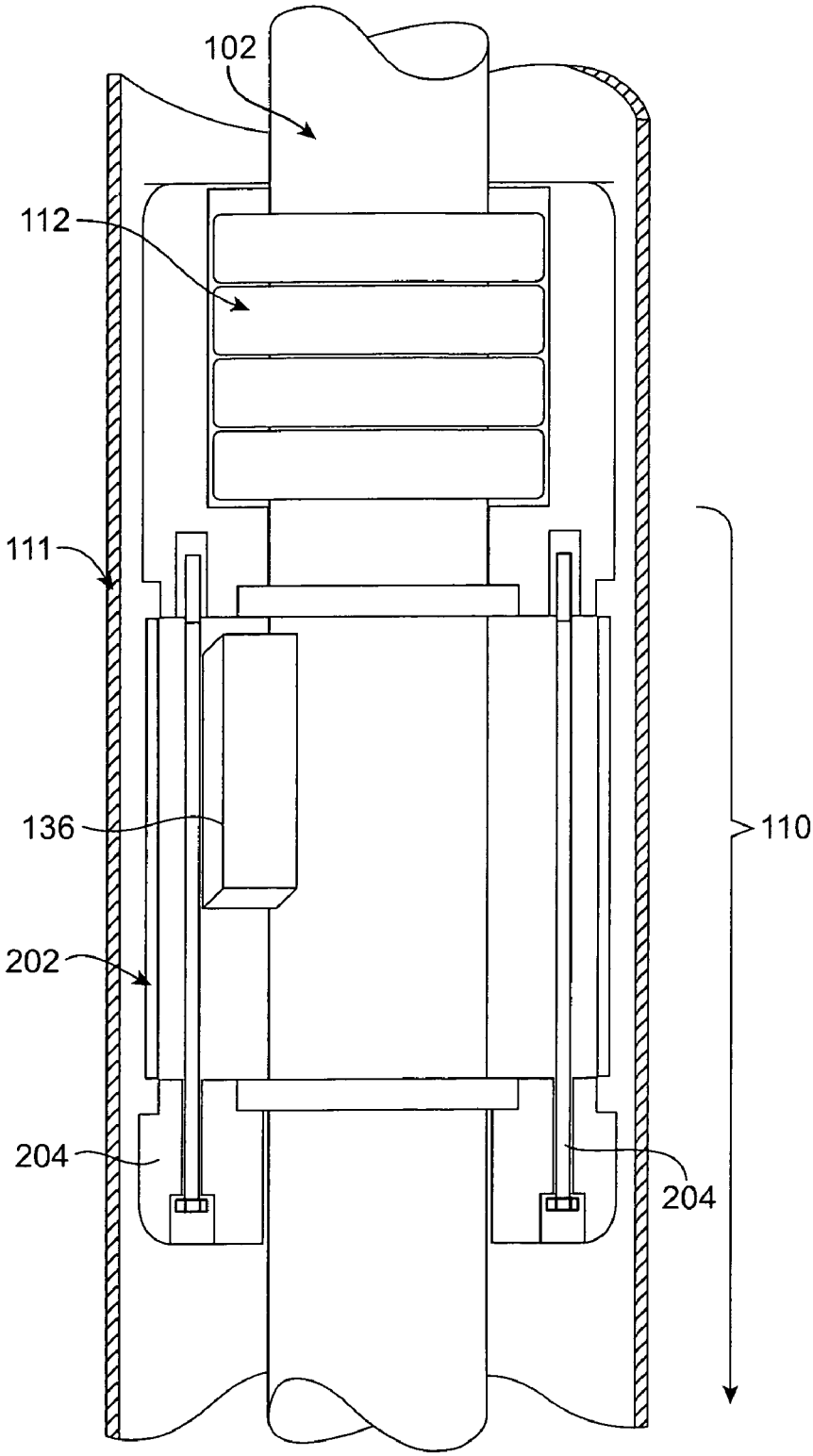
FIG. 2A shows an exemplary resonant cavity for use with the FIG. 1 apparatus.

FIG. 2A shows an exemplary detail of a resonant network device 110 formed as a resonant cavity. In FIG. 2A, the hollow borehole casing 111 can be seen to house the conductive pipe 102. The torroidal core 112 is illustrated, a bottom of which, in the direction going downward into the borehole, constitutes an upper end of the resonant cavity. The transducer 136 is illustrated as being located within a portion of the resonant cavity, and is associated with a conductive sensor sleeve 202, the capacitance of which is represented in FIG. 1C as the sleeve capacitance 134.

The ferrite torroidal core 112 can be configured as torroidal core slipped into a plastic end piece. Such ferrite materials are readily available, such as cores available from Fair-Rite Incorporated, configured as a low p, radio frequency type material, or any other suitable material. Mounting screws 204 are illustrated, and can be used to maintain the sensor sleeve and transducer in place at a location along a length of the conductive pipe 102. A bottom of the resonant cavity, which coincides with a common ground connection of the Packer to the hollow borehole casing, is not shown in FIG. 2.

Figure 2B:
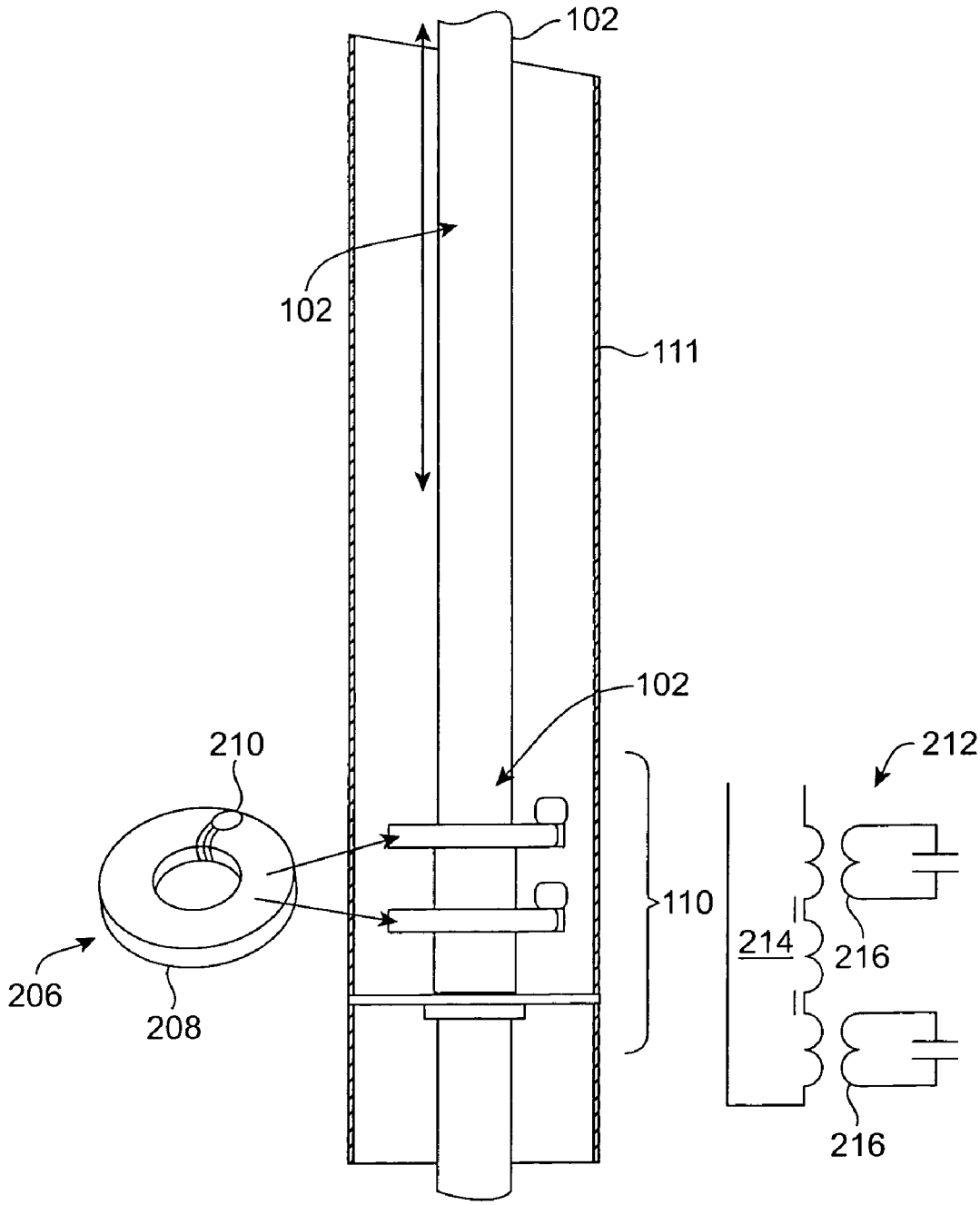
FIG. 2B shows an exemplary resonant network device formed as a magnetically coupled electrically resonant mechanical structure for performing electrical resonance.

FIG. 2B illustrates an exemplary detail of a resonant network 110 formed as a tank circuit. In FIG. 2B, multiple resonant network devices 206 associated with multiple sensor packages can be included at or near the Packer. In the FIG. 2B embodiment, resonators using capacitive sensors and ferrite coupling transformers are provided. Again, the hollow borehole 111 can be seen to house the conductive pipe 102. Each resonant network device is configured as a torroidal core 208 having an associated coil resonator 210. No significant impedance matching, or pipe-casing shorting modifications, to an existing well string need be implemented. The coaxial string structure can carry direct to a short at the Packer using the ferrite torroid resonators as illustrated in FIG. 2B, without a matching section as with the resonant cavity configuration.

In an electrical schematic representation 212, the conductive pipe can be effectively represented as a single turn winding 214 in the transformer construct, and several secondary windings 216 can be stacked on the single primary current path. The quality of the Packer short is of little or no significance. Metal-toothed Packers can alternatively be used. The return signal using this transformer method can be detected, in exemplary embodiments without using a low Packer shorting impedance.

In the exemplary FIG. 2B embodiment, spacing between multiple resonant network devices 206 can be selected as a function of the desired application. The resonant network devices 206 should be separated sufficiently to mitigate or eliminate mechanical constraints. In addition, separation should be selected to mitigate or eliminate coupling between them.

In an exemplary embodiment, one width of a ring can decrease coupling for typical applications. The inductance and/or capacitance of each resonance network device can be modified by adding coil turns, and the number of turns can be selected as a function of the application. For example, the number of turns will set a ring frequency of each resonant network device. Exemplary embodiments can be on the order of 3 to 30 turns, or lesser or greater.

In exemplary embodiments, the frequency used for the resonant network devices can be on the order of 3 MHz to 100 MHz or lesser or greater, as desired. The frequency can be selected as a function of the material characteristics of the conductive pipe (e.g., steel). Skin depth can limit use of high frequencies above a certain point, and a lower end of the available frequency range can be selected as a function of the simplification of the resonant network device construction. However, if too low a frequency is selected, decoupling from the wellhead connection short can be an issue.

Thus, multiple sensors can be included at a measurement site. The use of ferrite magnetic materials can simplify the downhole resonant network devices mechanically, and can allow less alterations to conventional well components.

Use of a ferrite magnetic torroid can permit magnetic material to enhance the magnetic field, and thus the inductance, in the current path in very localized compact regions. Thus, stacking of multiple resonant network devices at a remote site down the borehole can be achieved with minimal interaction among the multiple devices. Multiple sensor devices can be included to sense multiple characteristics. This can also allow for short isolation distances at the wellhead connection for coupling signal cables to the conductive pipe 102 as shown in FIG. 2C.

Figure 2C:
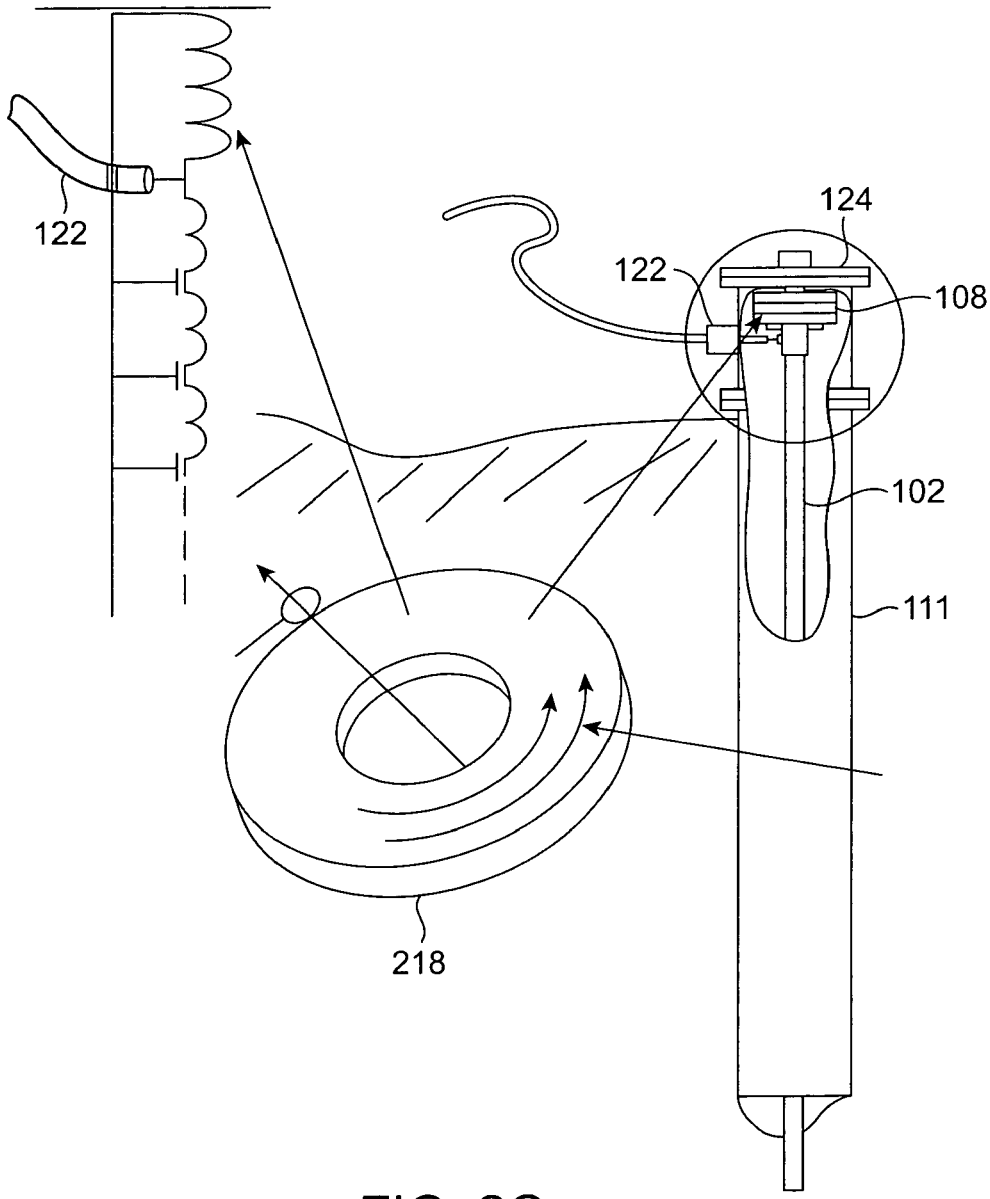
FIG. 2C illustrates an alternate exemplary wellhead connection.

FIG. 2C illustrates an exemplary alternate embodiment of a wellhead connection, wherein a spool 218 is provided to accommodate the ferrite isolator and signal connections. An exemplary spool can, for example, be on the order of 8 to 12 inches tall, or any other suitable size to accommodate the specific application. The spool is used for signal connection to the pipe string.

The resonant network device configured of a "torroidal spool" can be separated and operated substantially independent of sensor packages which are similarly configured, and placed in a vicinity of the spool 218. An increased inductance in a width of the torroid spool can be used to isolate the signal feed point at the wellhead connection. As is represented in FIG. 2C, current on the pipe surface will induce magnetic fields within the ferrite torroid for inductive enhancement of the pipe current path.

Figure 3:
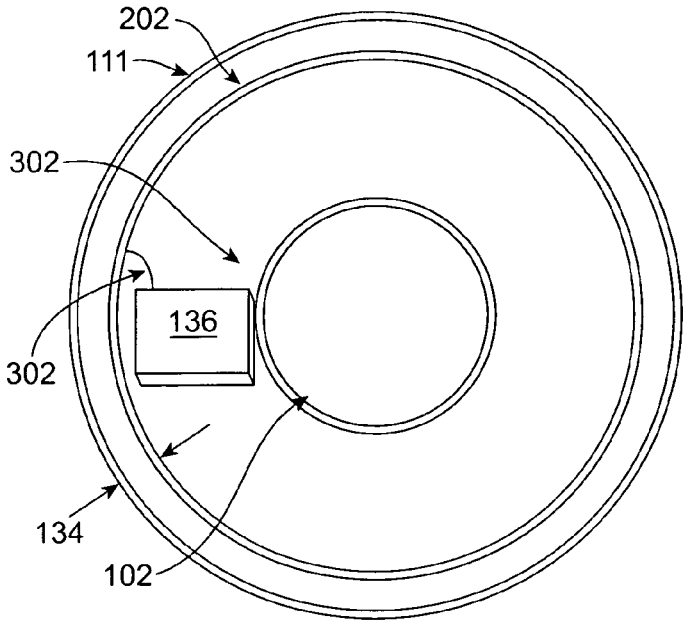
FIG. 3 shows a bottom view of the exemplary FIG. 2 resonant cavity.

FIG. 3 illustrates a view of the FIGS. 2A and 2B transducer from a bottom of the borehole looking upward in FIG. 2. In FIG. 3, the transducer 136 can be seen to be connected via, for example, electrical wires 302 to both the sensor sleeve 202 and the conductive pipe 102. The sensor sleeve in turn, is capacitively coupled to the hollow borehole casing 111 via the sleeve capacitance 134.

Figure 4:
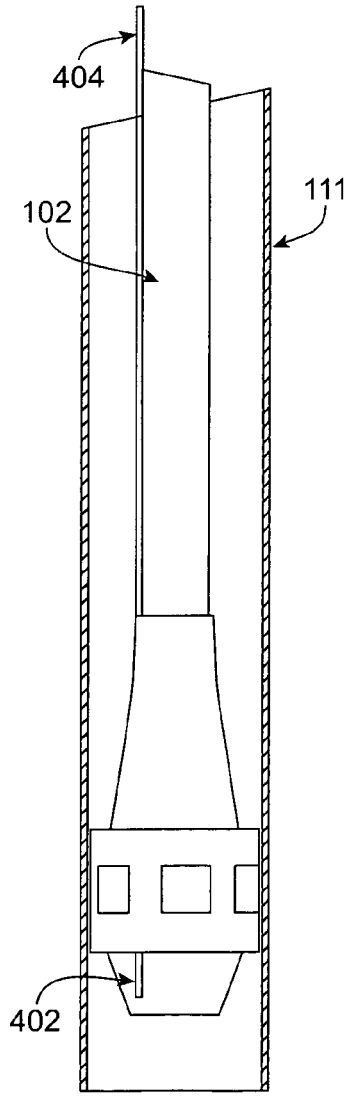
FIG. 4 shows an alternate exemplary embodiment of a resonant cavity wherein an exemplary mechanical or fluid feed to a transducer is located above a Packer seal.

FIG. 4 illustrates an alternate exemplary embodiment wherein the packer has been modified to include a conduit extension 402 into a zone of interest where the characteristic of the borehole is to be measured. This extension 402 can, in an exemplary embodiment, be a direct port for sensing, for example, a pressure or temperature using an intermediate fluid to the sensor.

In exemplary embodiments, transducers such as capacitive transducers, are mounted near the top of the resonant cavity as an electrical element of the sensor sleeve. Remote parameters can be brought to the sensor in the resonant cavity via a conduit that passes through and into a sealed sensing unit. The measurement of a desired parameter can then be remotely monitored. The monitoring can be extended using a mechanical mechanism from the sensor to relocate the sensor within the resonant cavity at different locations along the length of the conductive pipe 102. In FIG. 4, a sensor conduit 404 is pressure or temperature zone to be monitored.

Figure 5:
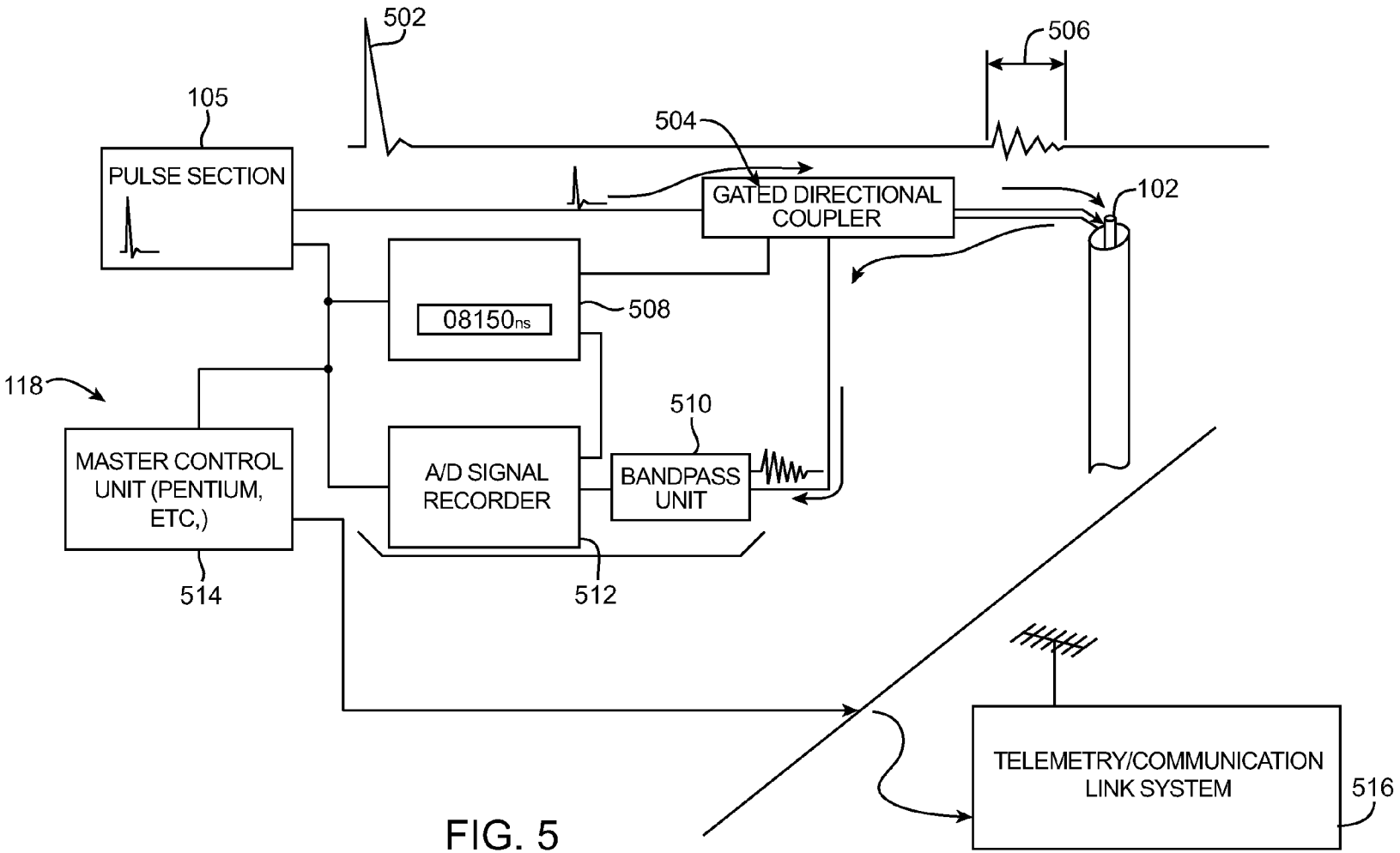
FIG. 5 shows an exemplary circuit for detecting a characteristic based on the sensing of a modulated vibration frequency using the exemplary FIG. 1A apparatus.

FIG. 5 shows exemplary electronics which can be implemented in the processor 118 for providing the signal processing already described. In an exemplary embodiment, the pulse generator 105 of FIG. 1A provides an impulse. The pulse can be a narrow pulse that can be generated using a readily available off-the-shelf pulse generator. An exemplary pulse is on the order of 1 to 2 nanoseconds at 75 volts, having a width at half of its height on the order of 3 nanoseconds. A peak voltage of the pulse is on the order of 10 to 1000 volts depending on, for example, a depth of the borehole. For example, at 30,000 feet, a 1000 volt pulse can be used. Those skilled in the art will recognize, however, that any desired pulse of any desired characteristic can be used provided a suitable response from the resonant network device can be achieved with a desired accuracy and tolerance of the characteristic.

In FIG. 5, a pulse section representing a pulse generator 105 of FIG. 1A is provided to transmit an exemplary impulse 502. This pulse is supplied to a gated, directional coupler 504 associated with the probe 106 of FIG. 1A. During an initial pulse, a high sensitivity receiver associated with the signal processor 118 is disabled, and the pulse is applied to the conductive pipe 102.

The processor 118 controls the gated, directional coupler 504 to gate the receiver on and thereby detect a return from the transducer located in the resonant cavity. This return is generally depicted as the modulated vibration frequency 506. A timing and delay system 508 can set a delay preset (e.g., 8150 nano seconds as illustrated in FIG. 5) to control the gating for receipt of the feedback pulse.

During the gating on of the receiver within the processor 118, the modulated vibration frequency passes through the gated directional coupler 504 and through a band pass filter unit 510. A filtered signal from the band pass filter unit 510 is supplied to an analog-to-digital signal recorder 512 and into a master control unit 514 (e.g., microprocessor, such as a Pentium, or other suitable microprocessor) of the processor 118. One skilled in the art will appreciate that any of the functionality illustrated in FIG. 5 can be implemented in hardware, software, firmware, or any combination thereof.

A telemetry/communication link system 516 can be provided to transmit information obtained from the borehole to any desired location. The telemetry/communication link system can be any suitable transmission and/or receiving system including, but not limited to wireless and/or wired systems.

Figure 6:
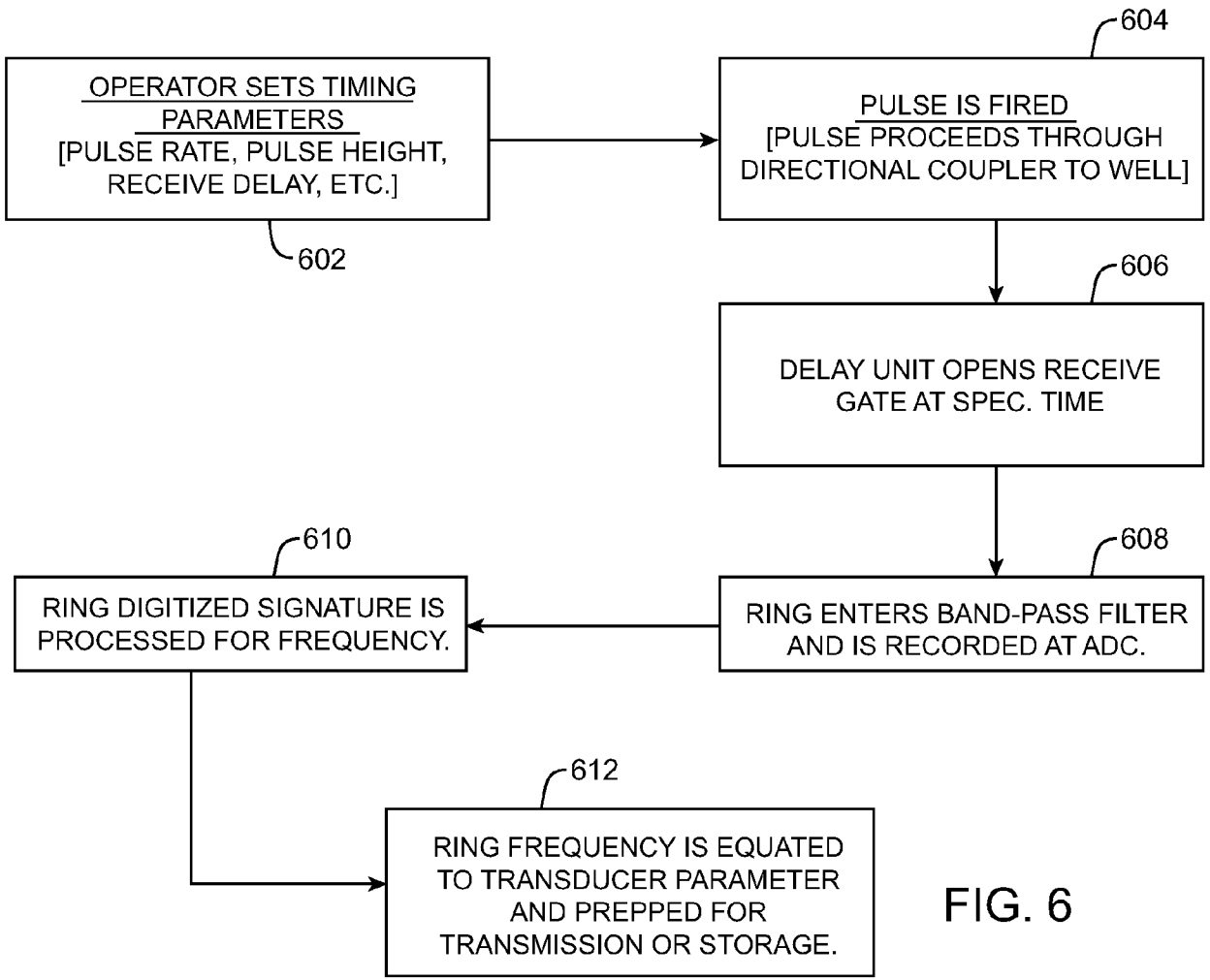
FIG. 6 shows an exemplary method for sensing a characteristic of a borehole.

FIG. 6 shows an exemplary method for sensing a characteristic of a borehole using, for example, an apparatus as described with respect to the preceding figures. In FIG. 6, at block 602, an operator can set timing parameters (e.g., via the graphical user interface). These parameters can include, without limitation, a pulse rate, a pulse height, a received delay, and so forth. In block 604, a pulse is supplied (e.g., fired) through the directional coupler, and into the conductive pipe of the borehole.

After a specified delay, at block 606 the timing and delay system 508 of FIG. 5 opens a receiving gate to detect the modulated vibration frequency from the transducer. This modulated vibration frequency constitutes a ring which enters the band pass filter in block 608, and which is recorded by the analog-to-digital recorder 512.

In block 610, a digitized signature of the ring can be processed for frequency, using, for example, a Fast Fourier Transform (FFT). In block 612, the ring frequency can be equated, through software such as look-up tables contained within the processor 118, to a particular characteristic, or transducer parameter, and then prepared for transmission or storage.

Those skilled in the art will appreciate that exemplary embodiments as described herein can provide down hole telemetry using passive techniques and resonant structures. As such, the apparatus as described herein can be exposed to a hostile environment such as the high temperature and pressure of a well borehole. Minute changes in a characteristic can be detected, so that the sensitivity to changes in a desired characteristic can be readily monitored and transmitted to a receiver for processing. Because reflection of incident power is used, no downhole battery or power supply is needed, which can reduce complexity.

Those skilled in the art will appreciate that in certain applications, fluid may be present in the well. Exemplary embodiments can employ techniques, such as the application of pressure, to force the fluid away from any portion of the conductive pipe and resonant cavity used for signal transmission where the fluid is expected to detrimentally influence signal detection. Alternately, fluids which will not impact the signal detection can be forced into the borehole to replace other fluids which may be detrimental to signal detection.

Those skilled in the art will appreciate that the disclosed embodiments described herein are by way of example only, and that numerous variations will exist. The invention is limited only by the claims, which encompass the embodiments described herein as well as variants apparent to those skilled in the art.

The invention claimed is:

1. Apparatus for sensing a characteristic of a borehole, comprising:

a conductive pipe;

an inlet coupled to the conductive pipe, for applying a pulse to the conductive pipe;

a resonant network device connected with the conductive pipe; and a transducer in operative communication with the resonant network device to measure a borehole characteristic, the transducer being configured to affect a modulation of a resonator vibration frequency induced in the resonant network device when a pulse is applied to the inlet; and wherein the inlet further includes:

a probe coupled with the conductive pipe; and an inductor for electrically isolating the inlet from a common ground potential at a location in a vicinity of the inlet, wherein the resonating means uses a magnetically coupled resonating network.

2. Apparatus according to claim 1, comprising:

a pulse generator coupled to the inlet for generating the pulse to be applied to the conductive pipe.

3. Apparatus according to claim 1, wherein the pulse is an electrical transient.

4. Apparatus according to claim 1, comprising:

a hollow borehole casing located within the borehole, wherein at least a portion of the hollow borehole casing is at a common ground, and wherein the conductive pipe is located within, and is electrically isolated from, the hollow borehole casing.

5. Apparatus according to claim 4, wherein the conductive pipe is electrically isolated from the hollow borehole casing using spacers located at multiple junctions of pipe sections used to form the conductive pipe.

6. Apparatus according to claim 4, wherein the hollow borehole casing is at a common ground potential at both the location in the vicinity of the inlet and at a location in a vicinity of a resonant cavity.

7. Apparatus according to claim 1, comprising:

a processor coupled with the transducer for processing an output of the transducer to provide a signal representing the characteristic.

8. Apparatus according to claim 1, wherein the characteristic is at least one of a material composition, a temperature, a pressure or a flow rate as sensed at a location along a length of the borehole.

9. Apparatus according to claim 1, wherein the inlet includes:

a probe coupled with the conductive pipe; and an inductor for electrically isolating the inlet from the first potential at the location in the vicinity of the inlet.

10. Apparatus according to claim 1, wherein the resonant network device is a resonant cavity located within a hollow borehole casing, a length of the resonant cavity within the hollow borehole casing being defined by an inductive isolator at a first end, and by a common ground connection at a second end.

11. Apparatus according to claim 1, wherein the transducer includes:

passive electrical components.

12. Apparatus for sensing a characteristic of a borehole comprising:

means for conducting a pulse through a borehole, the means for conducting the pulse including an inlet, coupled to the conducting means, for conducting the pulse to the conducting means;

means, responsive to the pulse, for resonating at a frequency which is modulated as a function of a characteristic of the borehole; and means for processing the modulated frequency as a measure of the characteristic;

wherein the inlet further includes:

a probe coupled with the conducting means; and an inductor for electrically isolating the inlet from a common ground potential at a location in a vicinity of the inlet, wherein the resonating means uses a magnetically coupled resonating network.

13. Apparatus according to claim 12, comprising:

means, connected with the inlet, for generating the pulse.

14. Apparatus according to claim 13, wherein the pulse is an electrical, transient pulse.

15. Apparatus according to claim 13, wherein the inlet further includes:

a probe coupled with the conducting means; and an inductor for electrically isolating the inlet from the common ground potential at the location in the vicinity of the inlet, wherein the resonating means uses a capacitively coupled resonating network.

16. Apparatus according to claim 13, wherein the inlet further includes:

a probe coupled with the conducting means; and an inductor for electrically isolating the inlet from the common ground potential at the location in the vicinity of the inlet, wherein the resonating means uses a magnetically coupled resonating network.

17. Apparatus according to claim 12, comprising:

a hollow borehole casing located within the borehole, wherein the conducting means is a conductive, cylindrical pipe located within, and electrically isolated from, the hollow borehole casing.

18. Apparatus according to claim 12, comprising:

a transducer for modulating the frequency to provide a signal representing the characteristic.

19. Apparatus according to claim 12, wherein the characteristic is at least one of a material composition, a temperature, a pressure or a flow rate as sensed at a location along a length of the borehole.

20. Method for sensing a characteristic of a borehole, comprising:

transmitting a pulse along a conductive pipe located within the borehole, wherein transmitting the pulse comprises transmitting the pulse to an inlet coupled to the conductive pipe; and sensing a modulated vibration frequency induced by the pulse within a resonant network device within a hollow borehole casing, as a measure of the borehole characteristic;

wherein the inlet further includes:

a probe coupled with the conductive pipe; and an inductor for electrically isolating the inlet from a common ground potential at a location in a vicinity of the inlet, wherein the resonating means uses a magnetically coupled resonating network.

21. Method according to claim 20, comprising:

processing the modulation of vibration frequency to provide a signal representing the characteristic.

22. Method according to claim 21, wherein the characteristic is at least one of a material composition, a temperature, a pressure or a flow rate as sensed at a location along a length of the borehole.

23. Method according to claim 20, wherein the processing includes:

performing a statistical analysis of the modulated vibration frequency.

24. Method according to claim 20, comprising:

calibrating a transducer used to produce the modulated vibration frequency before inserting the sensor into the borehole.

25. Apparatus for sensing a characteristic of a borehole, comprising:

a conductive pipe;

an inlet coupled to the conductive pipe, for applying a pulse to the conductive pipe;

a resonant network device connected with the conductive pipe wherein the resonant network device is a resonant cavity located within a hollow borehole casing, a length of the resonant cavity within the hollow borehole casing being defined by an inductive isolator at a first end, and by a common ground connection at a second end; and a transducer which is in operative communication with the resonant network device to measure a borehole characteristic, the transducer being configured to affect a modulation of a resonator vibration frequency induced in the resonant network device when a pulse is applied to the inlet.

* * * * *